US005392993A

United States Patent [19]

Fischer

[11] Patent Number: 5,392,993

[45] Date of Patent: Feb. 28, 1995

[54] FIRE PROTECTION NOZZLE

[75] Inventor: Michael Fischer, West Kingston, R.I.

[73] Assignee: Grinnell Corporation,, Cranston, R.I.

[21] Appl. No.: 184,871

[22] Filed: Jan. 21, 1994

[51] Int. Cl.[6] ..... B05B 1/26

[52] U.S. Cl. ..... 239/522; 239/498; 239/504; 239/524; 239/590; 169/38

[58] Field of Search ..... 169/37, 38, 39, 40, 169/41, 42, 90; 239/524, 498, 504, 601, 589, 590, 518, 522

[56] References Cited

U.S. PATENT DOCUMENTS

| | | | |
|---|---|---|---|
| Re.6,257 | 1/1875 | Parmelee . | |
| 137,095 | 3/1873 | Ransom . | |
| 269,930 | 1/1883 | Harris . | |
| 453,055 | 5/1891 | Ware | 239/504 |
| 488,003 | 12/1892 | Gilmore . | |
| 781,159 | 1/1905 | Reed . | |
| 1,315,079 | 9/1919 | Berna . | |
| 2,076,483 | 4/1937 | Rowley | 169/37 |
| 2,175,160 | 10/1939 | Zobel et al. | 239/589 |
| 2,310,798 | 2/1943 | Lewis . | |
| 2,361,144 | 10/1944 | Loepsinger . | |
| 2,433,463 | 12/1947 | Lampe . | |
| 2,436,335 | 2/1948 | Simenson . | |
| 2,448,792 | 9/1948 | Fraser . | |
| 2,516,401 | 7/1950 | Marcuse . | |
| 2,657,955 | 11/1953 | Manning . | |
| 2,726,897 | 12/1955 | Dupont . | |
| 2,985,381 | 5/1961 | Cadella | 239/280 |
| 3,061,204 | 10/1962 | MacInnes et al. | 239/522 |
| 3,130,920 | 4/1964 | Devillard . | |
| 3,171,248 | 3/1965 | Ledwith . | |
| 3,214,103 | 10/1965 | Kempthorne . | |
| 3,342,419 | 9/1967 | Weese . | |
| 3,550,864 | 12/1970 | East . | |
| 3,603,512 | 9/1971 | Ham | 239/504 |
| 3,684,194 | 8/1972 | Wayne | 239/600 |
| 3,768,736 | 10/1973 | Cox | 239/504 |
| 3,802,512 | 4/1974 | Todtenkopf | 239/504 |
| 3,821,986 | 7/1974 | Livingston | 169/41 |
| 3,872,928 | 3/1975 | Livingston | 169/56 |
| 3,884,305 | 5/1975 | Livingston | 169/37 |
| 4,092,003 | 5/1978 | Ikeuchi | 239/590 |
| 4,228,956 | 10/1980 | Varner | 239/237 |
| 4,279,309 | 7/1981 | Fischer | 239/601 |
| 4,360,156 | 11/1982 | Soth et al. | 239/600 |
| 4,480,793 | 11/1984 | Grande | 239/567 |
| 4,660,648 | 4/1987 | Zen | 169/41 |
| 4,711,277 | 12/1987 | Clish | 239/567 |
| 4,800,961 | 1/1989 | Klein | 169/37 |
| 4,842,199 | 6/1989 | Drechsel | 239/230 |
| 4,854,388 | 8/1989 | Wyatt | 169/38 |
| 4,901,799 | 2/1990 | Pepi et al. | 169/38 |
| 4,976,320 | 12/1990 | Polan | 169/39 |
| 4,989,675 | 2/1991 | Papavergos | 169/14 |
| 4,991,656 | 2/1991 | Polan | 169/39 |
| 5,067,655 | 11/1991 | Farago et al. | 239/124 |
| 5,195,592 | 3/1993 | Simons | 169/37 |

FOREIGN PATENT DOCUMENTS

| | | | |
|---|---|---|---|
| 3440901A1 | 7/1985 | Germany . | |
| 435990 | 11/1967 | Switzerland . | |
| 1350991 | 4/1974 | United Kingdom | 169/41 |
| 2076696A | 12/1981 | United Kingdom . | |
| 2195241 | 4/1988 | United Kingdom | 169/37 |
| WO89/05195 | 6/1989 | WIPO . | |
| WO92/15370 | 9/1992 | WIPO . | |
| WO92/19324 | 11/1992 | WIPO . | |
| WO92/20453 | 11/1992 | WIPO . | |
| WO92/20454 | 11/1992 | WIPO . | |

*Primary Examiner*—Andres Kashnikow
*Assistant Examiner*—Christopher G. Trainor
*Attorney, Agent, or Firm*—Fish & Richardson

[57] ABSTRACT

A fire protection nozzle of this invention has a base defining an orifice and an inlet section defining a conduit for flow of fire-retardant fluid, leading to an upstream end of the orifice. A diffuser is supported by arms extending from the base in a position downstream of the orifice where fire-retardant fluid flowing from the inlet section emerges from the orifice in a coherent stream which impinges on the diffuser to be deflected in a spray pattern. The inlet section, in the direction of the fire-retardant fluid flow, has a cross-sectional shape of an inwardly convex curvilinear arc with a length equal to or greater than the diameter of the orifice. In a preferred embodiment, the diffuser defines two or more slots, each having a cross-sectional open area equal to at least eight percent of the total cross-sectional area of the diffuser measured in a plane transverse to the direction of fire-retardant fluid flow from the orifice.

19 Claims, 2 Drawing Sheets

FIRE PROTECTION NOZZLE

FIELD OF THE INVENTION

This invention relates to manually or automatically operated nozzles for use in discharging fire-retardant liquids.

BACKGROUND OF THE INVENTION

Fire protection nozzles are used to discharge water, with or without additives, in a relatively fine spray, which is generally referred to in the industry as mist. Nozzles with an inwardly curvilinear inlet section and, in particular, nozzles with an inwardly convex section for which normals to the tangent lines at neighboring points on the curve tend to diverge, are utilized for the purpose of discharging a fire-retardant liquid.

Various types of nozzles discharging a fine water spray have long been used in fire protection systems. Although often not described as such at the time, perforated diffuser sprinklers such as described in Parmalee U.S. Pat. No. 6,257 discharged water in a fine spray by nature of the diffuser holes being in the order of 0.06 inch in diameter. Other examples of fine spray nozzle designs intended for use in fire protection system applications are described in Lewis U.S. Pat. No. 2,310,798, which is based on the use of impinging jets to create a "cloud" of spray, as well as Loepsinger U.S. Pat. No. 2,361,144 and Papavergos U.S. Pat. No. 4,989,675, which are based on establishing a gas-water mixture to create an atomized spray. Further techniques for delivering fine spray for fire suppression purposes include: using an array of nozzles originally designed for fine oil mist atomizing, e.g. in oil burner applications, and using nozzles with an internal fixed scroll, or a whirling device, e.g. as described in PCT Publication No. WO 92/20454.

The mechanism(s) by which fine spray (water mist) acts to control, suppress or extinguish a fire can be a complex combination of two or more of the following factors, depending on the operating concept of the individual nozzle, the size of the orifice(s), the operating pressure and flow rate:

1. Heat extraction from the fire as water is converted into vapor

The amount of evaporation and hence heat withdrawn from the fire (i.e., cooling of the fuel) is a function of surface area of water droplets applied, for a given volume. Reducing droplet size increases surface area and increases the cooling effect of a given volumetric flow rate of water.

2. Reduced oxygen levels as the vapor displaces oxygen near the seat of the fire When water converts to vapor, it expands by a factor of about 1650 times, displacing and diluting oxygen, thereby blocking the access of oxygen to the fuel. Arsonist fires in enclosures are, therefore, the easiest for water mist systems to extinguish because of the virtually instantaneous vaporization which can occur due to the relatively high level of heat present at nozzle operation, even with fast response release elements.

3. Deluging of the protected area

Small water droplets are extremely light, and tend to remain suspended with the slightest air currents. This results in a "mist" that tends to distribute itself throughout an enclosure, outside of the direct spray range of an individual nozzle. Fine water droplets are, therefore, more likely to be drawn into the seat of the fire, further enhancing the effectiveness of the system by chemically inhibiting the combustion radicals. This three-dimensional effect of the expanding mist also acts to cool the gases and other fuels in the area, blocking the transfer of radiant heat to adjacent combustibles, as well as, pre-wetting them.

4. Direct impingement wetting and cooling of combustibles

In addition to the pre-wetting and cooling of the flames by vaporizing water droplets, fire extinguishment by direct contact of the water droplets with the burning fuel to prevent further generation of the combustible vapors is one of the modes of fire extinguishment normally associated with traditional sprinklers having orifice diameters most often of about 0.44 inch or larger. However, with a fast response release mechanism, high momentum mist can be effective in this mode during the early development stage of exposed fires.

Generally speaking, the sizes of the orifices used in water mist nozzles are in the order of 0.06 inch in diameter or less, with the orifice diameter becoming smaller as the flowing pressure is increased, in order to restrict the flow to a reasonable value. For example, nozzle assemblies made up of fine oil mist-type sprayers generally have orifice diameters in the order of 0.02 inch or smaller and are operated at pressures of about 1,000 psig or higher. As compared to traditional sprinklers with orifice diameters most often of about 0.44 inch or larger, water mist nozzles with orifice diameters of about 0.06 inch or smaller require the use of fine inlet mesh strainers to prevent clogging due to debris in the water supply, while nozzles with orifice diameters of 0.02 inch or smaller are considered to be excessively susceptible to clogging by either debris or mineral deposits in the water supply or corrosive atmospheres like that associated with a marine environment. As such, very fine mesh inlet strainers are needed to protect the orifices, the nozzle bodies need to be made of costly corrosion resistant materials and, in addition, the use of deionized water as well as protective exterior caps (which would blow off following nozzle operation), should be considered. Lastly, operation of water pumps at 1,000 psi or higher, especially in marine service, raises questions as to the degree of maintenance required in order to ensure the level of reliability necessary for helping to assure safety of life in a fire situation.

Dual media water mist systems such as the gas-water mixture system described in Papavergos U.S. Pat. No. 4,989,675 tend to have a larger and more acceptable water discharge orifice diameter (in the order of 0.12 inch) and operate at pressures in the order of 45 psig to 75 psig. However, dual media systems have the extra costs and complexity associated with installing two sets of piping to each nozzle, they must be operated as a deluge system (e.g., water is flowed from a number of nozzles at once, to cover a relatively wide area), and a separate source of relatively high flow rate compressed gas must be maintained. The gas source is normally provided by using cylinders of compressed nitrogen at pressures of greater than 2,000 psig, and, because of the fixed volume of gas supply, it is also necessary to make provisions for discharging multiple shots of the water mist, with each shot lasting a few minutes, in the event that the fire re-ignites after the first shot of the mist. This makes the equipment more complex and costly. Lastly, with the dual media system, care must be taken to prevent over-pressurization of a compartment, otherwise structural damage to the compartment might result upon release of the gas-water mixture.

There is also a variety of background information concerning nozzles, with various types of inwardly convex curvilinear inlet sections for which normals (i.e., perpendiculars) to tangents at neighboring points on the curve tend to diverge, that have been used for applications such as discharging: fire-retardant fluids, water for irrigation, rocket fuels, and chemicals used in industrial processes. Prior art illustrating nozzles with various types of inwardly convex curvilinear inlet sections, which are used for discharging fire-retardant liquids, include the following: Gilmore U.S. Pat. No. 488,003; Reed U.S. Pat. No. 781,159; Berna U.S. Pat. No. 1,315,079; Livingston U.S. Pat. No. 3,872,928; Livingston U.S. Pat. No. 3,884,305; Klein U.S. Pat. No. 4,800,961; Polan U.S. Pat. No. 4,991,656 and Simons U.S. Pat. No. 5,195,592.

Prior art nozzles for irrigation applications are described in Varner U.S. Pat. No. 4,228,956 and Drechsel U.S. Pat. No. 4,842,199. A prior art nozzle with inwardly convex inlet sections for use in rocket fuel applications is described in Ledwith U.S. Pat. No. 3,171,248, while prior art nozzles with inwardly convex inlet sections for use in chemical process applications are described in Devillard U.S. Pat. No. 3,130,920 and East U.S. Pat. No. 3,550,864.

SUMMARY OF THE INVENTION

It is an objective of this invention to provide an improved fine spray (water mist) fire extinguishing nozzle that is simple, reliable and low cost for manufacture.

It is a further objective of this invention to provide a water mist nozzle that can be individually automatically released (operated), a nozzle that is effective for extinguishing certain classes of fires at a flowing pressure as low as about 87 psig. It is also an objective of this invention to provide a nozzle which discharges a fine spray (water mist) with an orifice diameter equal to or larger than 0.10 inch, so that the strainer used to protect the orifice from clogging due to debris in the water supply will not require unusually small and costly perforations, and so that the orifice will not be subject to clogging due to mineral deposits such as calcium in the water supply.

Objectives of this invention have been discovered to be achievable with an individually automatically operating nozzle.

In particular, according to the invention, a fire protection nozzle comprises a base, an orifice, defined by the base and having a predetermined diameter, through which fire-retardant fluid can flow, an inlet section defining a conduit for flow of fire-retardant fluid and leading to an upstream end of the orifice, a diffuser element positioned downstream of the orifice, and one or more arms extending from the base and supporting the diffuser element in a position, where, when flow of fire-retardant fluid from the inlet section through the orifice is established, the fire-retardant fluid emerges from the orifice in a coherent stream which impinges on the diffuser element to be deflected in a spray pattern, the inlet section, in the direction of fire-retardant fluid flow, having a cross-sectional shape of an inwardly convex curvilinear arc, and the inlet section having a length equal to or greater than the diameter of the orifice.

Preferably, the inwardly convex curvilinear arc of the cross-sectional shape of the inlet section has the form of a circular arc, with the center of the circular arc located proximate to the plane of the upstream end of the orifice, and the radius of the circular arc is between one and three times the diameter of the orifice, and, more preferably, the radius of the circular arc is approximately 1.5 times the diameter of the orifice.

In an alternative embodiment, the inwardly convex curvilinear arc of the cross-sectional shape of the inlet section has the form of an ellipse with the center of the ellipse located proximate to the plane of the upstream end of the orifice. Preferably, the ellipse has a major axis with a length between 1.5 and 4.0 times, and preferably nominally 2.0 times, the diameter of the orifice, and the ellipse has a minor axis with a length between 1.0 and 3.0 times, and preferably nominally 1.3 times, the diameter of the orifice.

In another alternative embodiment, the inwardly convex curvilinear arc of the cross-sectional shape of the inlet section has the form of a smooth blend of two or more circular arcs of different radii, the two or more circular arcs in combination approximating the form of an ellipse.

Preferred embodiments of this aspect of the invention may include one or more of the following additional features. The cross-sectional area of the conduit, measured in a first plane at the upstream end of the inlet section and transverse to the direction of fire-retardant fluid flow, is at least seven times the cross-sectional area of the orifice measured in a second plane transverse to the direction of fire-retardant fluid flow. The diameter of the orifice is between about 0.08 inch and 0.20 inch, and preferably nominally 0.11 inch. The orifice has an exit end contour essentially in the form of a square corner.

According to another aspect of the invention, a fire protection nozzle comprises a base, an orifice defined by the base through which fire-retardant fluid can flow, an inlet section defining a conduit for flow of fire-retardant fluid leading to the orifice, a diffuser element positioned downstream from the orifice, and one or more arms extending from the base for supporting the diffuser element, in a position where, when flow of fire-retardant fluid through the orifice is established, the fire-retardant fluid emerges from the orifice in a coherent stream and impinges on the diffuser element to be deflected in a spray pattern, the diffuser element defining two or more slots, the diffuser element having a total cross-sectional area measured in a plane transverse to the direction of fire-retardant fluid flow from the orifice, and each slot having a cross-sectional open area, measured in the plane, equal to at least eight percent of the total cross-sectional area of the diffuser element.

Preferred embodiments of this aspect of the invention may include one or more of the following additional features. The diffuser element and the orifice are coaxial arranged, and each slot has a long axis disposed transverse to a radial line drawn from the axis of the diffuser element. The diffuser element and the orifice are coaxial arranged, and the diffuser element defines four slots, each slot having a cross-sectional open area measured in the plane approximately equal to ten percent of the total area of the diffuser element in the plane, and each slot has a long axis disposed transverse to a radial line drawn from the axis of the diffuser element. The diffuser element and orifice are coaxially arranged, each slot has a long axis disposed substantially transverse to a radial line drawn from the axis of the diffuser element, and an open channel is defined between the associated slot and an outer edge of the diffuser element, the channel being narrower than the associated slot. Preferably, the channel has an axis generally aligned with a radial line drawn from the axis of the diffuser element and/or substantially transverse to the long axis of the associated slot.

These and other features and advantages of the invention will be apparent from the following description of a presently preferred embodiment, and from the claims.

DESCRIPTION OF THE PREFERRED EMBODIMENTS

Figure 1:
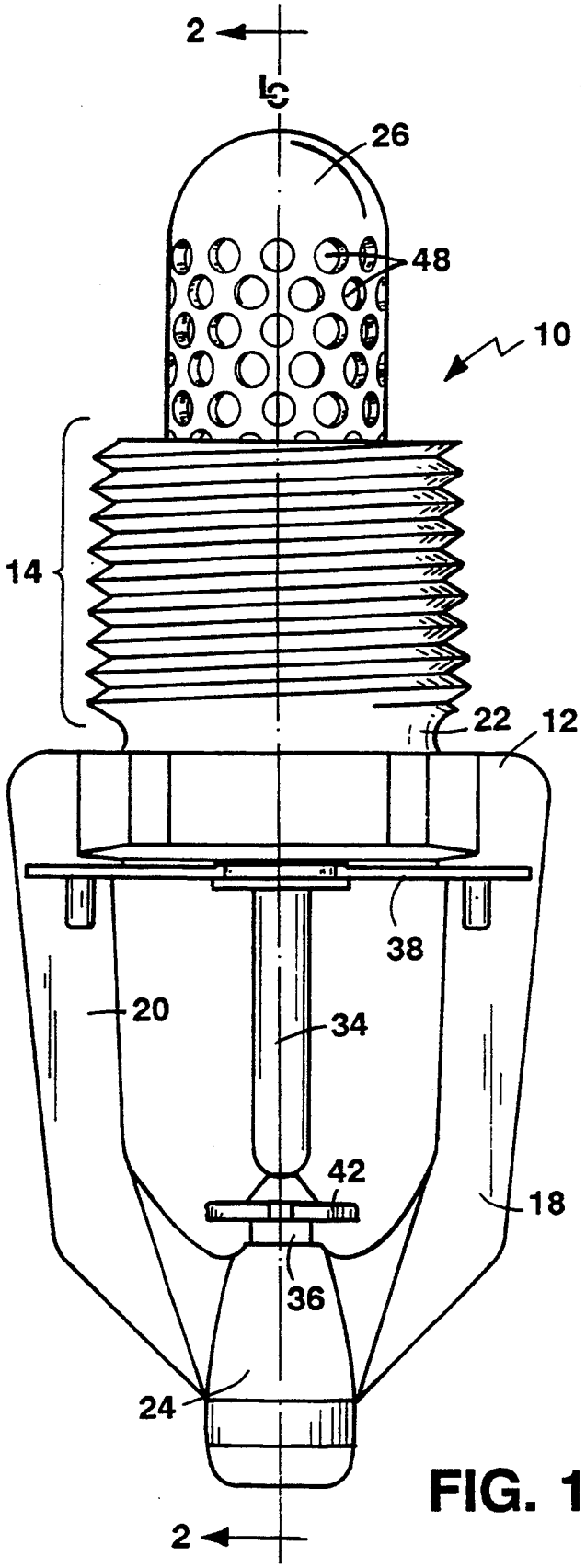
FIG. 1 is a face view of a fine spray fire protection nozzle of the invention.
Figure 2:
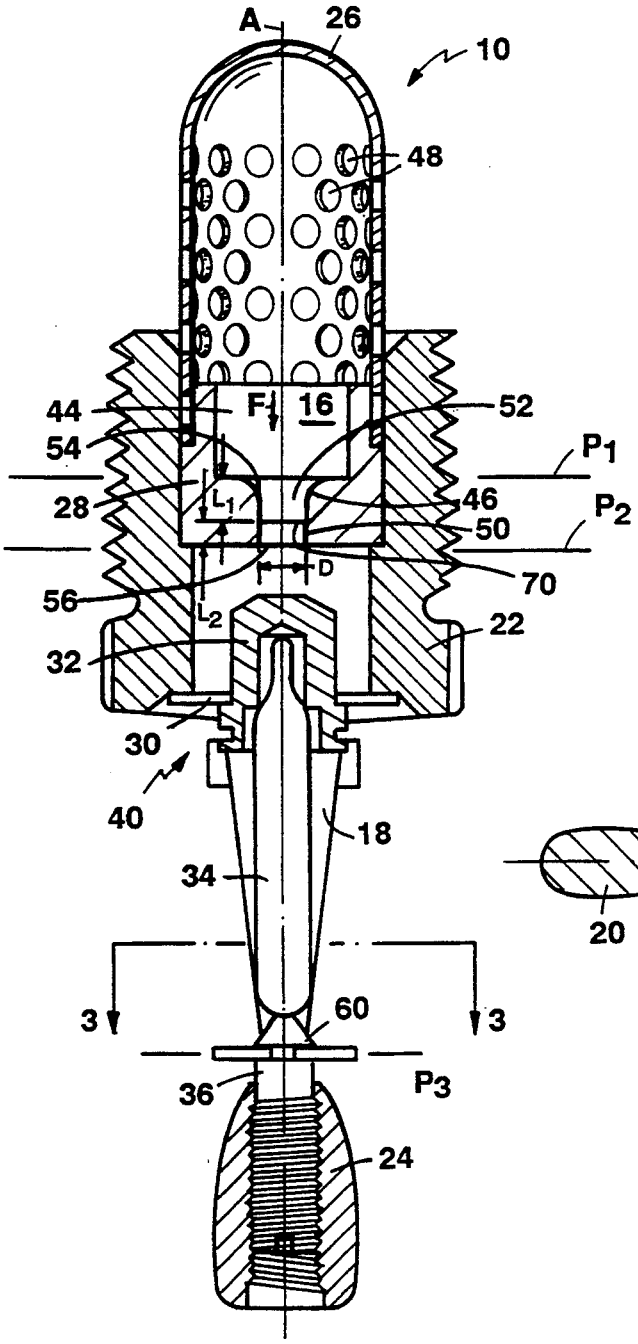
FIG. 2 is a side sectional view of the fine spray fire protection nozzle of the invention, taken at the line 2—2 of FIG. 1.

Referring to FIG. 1, an individually automatically operating nozzle 10 includes a frame 12 with external threads 14 for sealingly connecting it to a fire retardant fluid supply system (not shown). Referring also to FIG. 2, an axial passageway 16 defined through the frame 12 communicates from the fluid supply to the exterior of the frame. Arms 18, 20 extend from the main body 22 of the frame to an apex 24 positioned away from and coaxial with the passageway in the frame 12, much the same as in traditional sprinkler heads typically used for automatic fire protection system service.

A strainer 26 is positioned across the passageway 16 in manner to protect the orifice insert 28 from potential clogging due to debris in the fluid supply system. A spring seal 30 and button 32 sealingly close the passageway through the frame 12, and the opening is held closed by a frangible bulb-type heat-responsive release element 34 which bears between the button 32 and deflector-loading screw 36, which is threaded into frame 12 at the apex 24 of arms 18, 20 extending from the frame. An ejection spring 38 imposes a lateral force on the button-and-spring-seal sub-assembly 40 such that when the release element 34 bursts at a predetermined temperature due to exposure to the abnormally high temperatures caused by a fire, the button 32 and spring seal 30 are thrown to the side from their normal or standby sealing position, thereby to allow fluid to discharge through the passageway 16 and impinge upon the down-stream diffuser element 42, secured by the deflector-loading screw 36, to form the desired water spray pattern. In principle, the device as so far described operates in much the same way as the traditional automatic sprinklers used today in fire protection system service.

Referring again to FIG. 2, in an individually automatically operating nozzle 10 of the invention, the nozzle entrance region 44 upstream of the orifice inlet section 46 is pressurized with fire retardant fluid which is supplied by the connection to the fire protection system piping and flows through the perforations 48 in the strainer 26. The exact shape or cross-sectional area of entrance region 44 and perforations 48 are not critical to the fine spray forming qualities of the nozzle 10 of this invention. However, it is preferable, for the purpose of realizing the objectives of this invention, that the entrance region have a cross-sectional area, measured in a plane, $P_1$, transverse to the axis, A, of the direction of fire retardant fluid flow through the orifice 50, in the order of eight or more times the cross-sectional area of the orifice 50, measured in a plane, $P_2$, also transverse to the axis, A, of the direction of fire retardant fluid flow through the orifice 50. It is also preferable for the purpose of realizing the objectives of this invention that the perforations 48, taken together, have a total cross-sectional open area in the order of 20 or more times the area of the orifice 50, to avoid introduction of significant alteration to the flow characteristics through the passageway 16 formed by the orifice inlet section 46 and orifice 50, over the pressure (flow) range of interest. The size of the individual strainer perforations 48 must, however, be smaller than that of the orifice 50, so that any debris which is small enough to pass through the perforations is also sufficiently small to pass through the orifice inlet and thus not clog the orifice. The total cross-sectional area for the strainer needs to be greater than that for the orifice inlet, in order to allow for the partial blockage effect created by any debris collecting around the outside of the strainer.

Heretofore, the discharge streams and resulting spray patterns of nozzles (sprinklers) with orifice diameters less than 0.20 inch and passageway configurations like those described in the prior art have been known to be stable only over a relatively limited range of pressures, up to pressures in the order of 80 psig. At higher pressures, the flow stream exiting the orifice becomes unstable for at least two reasons which have been found to be of particular importance: the first being due to a change in direction of the fluid entering the orifice area, and the second being due to discontinuities in the contour of the exit or downstream end of the orifice.

However, the instabilities described above are unacceptable in the case of a nozzle having an orifice diameter of about 0.11 inch, as necessary for discharge of a suitable fine spray (water mist), since it has been found that a minimum pressure of about 87 psi is needed to establish the momentum required for penetration of the fine spray through the updrafts created by a fire. These instabilities would also be unacceptable for a fine spray device expected to operate in much the same manner as traditional automatic sprinklers, since the latter are typically rated for use at a maximum service pressure of 175 psig.

With respect to the first described cause of instability, what would appear to be smooth changes in the contour of the inlet section, e.g. as described in Polan U.S. Pat. No. 4,976,320 and Simons U.S. Pat. No. 5,195,592, as well as in Klein U.S. Pat. No. 4,800,961, can actually cause detachment of the flow stream from the wall of the waterway at pressures greater than about 80 psig and with orifice diameters less than 0.20 inch. This detachment from the wall, especially in an area immediately upstream of the orifice, causes a collapse in the diameter of the flow stream, and, slightly further on, an expansion of the flow stream into a conical condition. This expansion from a cylindrical shape at pressures higher than that which produces detachment significantly alters the resultant water spray pattern of nozzles utilized with diffusers. Since the expanded flow stream impinges the diffuser over a larger area, and most often in the area of the diffuser slots which are needed to produce an acceptable distribution of the water, the spray pattern collapses to a size unacceptably smaller than the size of the spray pattern in the stable pressure range.

In the present invention, it has been found that the fluid stream exiting from an orifice 50 having a diameter, D (measured in the region of plane $P_2$), of about 0.11 inch can be made extremely stable, without any significant alteration of the water spray pattern, up to pressures of more than 300 psi by utilizing an inwardly convex, curvilinear shape for the surface 54 of the inlet region 52 of section 46 into the orifice 50 for which normals to the tangent lines at neighboring points on the curve surface 54 tend to diverge, in combination with particular dimensions in relationship to the diameter, D, of the orifice 50.

In the ideal case, it has been found that in order to provide an extremely stable (i.e., essentially non-expanding) flow stream, for the fluid exiting the nozzle orifice 50, the orifice inlet region 52 must provide a surface 54 which smoothly and gradually blends the transition from the entrance to the orifice 50, such that discontinuities in the fluid flow do not occur in the passageway from the start of the inlet region 54 (in the region of plane $P_1$) to the end of the orifice 50 (in the region of plane $P_2$). A significant improvement in the flow stable pressure to a minimum of about 130 psig is achieved by making the cross sectional shape of the curvilinear inlet region (in the direction of flow of fire retardant fluid, arrow F) a circular arc having a radius equal to at least 1.0 times the diameter, D, of the orifice 50. However, a still further increase in the flow stable pressure to more than 300 psig has been obtained by making the cross sectional shape of the surface 54 of curvilinear section in the region 46 an elliptical arc, wherein the length of the major axis of the ellipse is approximately equal to twice the diameter, D, of the orifice 50 and the length of the minor axis of the ellipse is approximately equal to 1.3 times the orifice diameter. It has also been found that combinations of two or more radii can be used to approximate the shape of an ellipse, as long as all radius transition points are smoothly blended.

In addition to the shape of the surface 54 defining the orifice inlet region 52 being of critical importance in the stability of the fluid stream being discharged from the orifice 50, when used in conjunction with a downstream diffuser 42, the contour of the exit or downstream end 56 of the orifice 50 is also extremely important. If the corner of the exit 56 of the nozzle orifice 50 of this invention could be fabricated in general production with a chamfer or radius which was perfectly concentric with the orifice 50 and perfectly symmetrical about any radial axis, then the flow stream would run straight and true to the center axis, A, of the diffuser 42. However, from a practical standpoint, this is not achievable at an acceptable cost because the orifice inlet section 46 and the contour around the exit end 56 of the orifice 50 must be machined from opposite ends; and, the consequences of even slight variations in the concentricity or symmetry of the contour around the exit end of an orifice of the size in the nozzle of this invention can cause the flow stream to diverge from the longitudinal axis, A, of the orifice 50 and produce an unacceptable dislocation of the spray pattern. However, it has been found that if the corner of the exit end 56 of the orifice 50 is made an essentially sharp corner, in addition to removing any burrs left from the orifice machining operation, the flow stream emanating from the orifice will run straight and true to the center axis, A, of the diffuser 42.

In the preferred embodiment of this aspect of the invention, the nominal diameter of the orifice 50 is 0.106 inch, and the cross sectional shape of the surface 54 in the region 52 of the orifice inlet section 46 is in the form of a quadrant of an elliptical arc, with the major axis of the ellipse being nominally 0.212 inch long and the minor axis of the ellipse being nominally 0.142 inch long. Further, the tangent to the elliptical surface 54 at the minor axis is coincident with the upstream edge 70 of the orifice 50 or, in other words, the length of one-half the major axis of the ellipse is equal to the length, $L_1$, of the orifice inlet section. The length, $L_2$, of the orifice is nominally 0.064 inch long, and the corner edge around the exit end 56 of the orifice 50 is essentially square.

Figure 3:
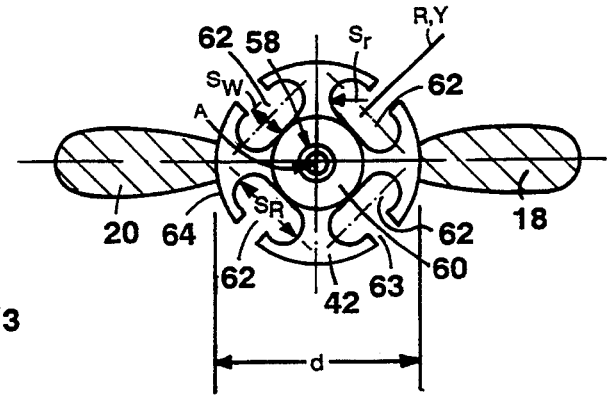
FIG. 3 is a top sectional view of the diffuser element of a fine spray fire protection nozzle of the invention, taken at the line 3—3 of FIG. 2.

Referring now also to FIG. 3, another aspect of this invention involves the unique and unusually shaped diffuser element 42 of the deflector-loading screw 36. The diffuser element 42, which establishes the water spray pattern, is located downstream of the orifice 50 and the size of the diffuser element is relatively small, in proportion to the diameter of the flow stream. The diffuser element of this invention is unusual in that the deflector-loading screw 36 is of one-piece construction; however, it functions similarly to diffusers of traditional automatic sprinklers of larger orifice diameters by causing the flow stream emanating from the orifice to be broken up into a pattern of spray; with the size of the pattern, drop size and distribution of droplets within the over-all pattern being variable in accordance with the geometry of the diffuser.

In the embodiment of FIG. 1, the seat 58 for the release element 34 and the conical surface 60 have an effect on the water spray pattern distributed by the diffuser 42, and, as such, are considered to be part of the diffuser when referring to it herein.

Of a unique nature is the configuration of the four diffuser slots 62 which are elongated in a direction substantially perpendicular or transverse to a radial line, R, drawn from the center axis, A, of the diffuser. The transversely orientated slots 62 provide sufficient flow area through the diffuser 42 such that four, web-like spray components, each containing a relatively large portion of the total discharge volume, are created. These web-like spray components are composed of a wide range of drop sizes specifically placed within the web, from fine spray (mist) size to the larger droplets associated with traditional sprinklers having an orifice diameter of 0.44 inch or larger. The larger droplets are incorporated to help penetrate updrafts created by an exposed fire when the nozzle 10 is located at a relatively high ceiling-to-floor distance, e.g. 16 feet, as well as to help draw the finer spray along toward the fire and to the floor as well. In addition, when nozzles 10 of the invention are used at a more typical ceiling-to-floor distance of about 8 feet, the momentum of the web-like spray components (in addition to their entrained air flow) impinging against the floor as well as furniture causes the spray to be carried outward such that portions of the spray become re-distributed into more remote or concealed areas that would otherwise not be in the direct line of spray from the nozzle. In order to achieve these desired attributes, the cross-sectional open area of each of the four transverse orientated slots (measured in a plane, $P_3$, transverse to the axis, A, of the diffuser element 42) must be at least 8 percent of the total cross-sectional area of the diffuser (including the release element seat 58 and conical surface feature 60)

projected into plane, $P_3$. FIG. 3 also illustrates a channel-like connection 63 between each slot 62 and the outside edge 64 of the diffuser element 42, each channel being narrower than the width of the slot and being disposed to produce a predetermined desired spray pattern.

In preferred embodiments of this aspect of the invention, the outside diameter, d, of the diffuser is nominally 0.350 inch. Each slot 62 has an over-all length, $S_1$, in the transverse direction of nominally 0.150 inch and an over-all width, $S_w$, of nominally 0.072 inch. The end of each slot is a semi-circle having a radius, $S_r$, of nominally 0.036 inch. As a result, each slot 62 has a nominal area of 10 percent of the total area of the diffuser, projected into a plane, $P_3$. The width of each channel 63 is nominally 0.056 inch.

Other embodiments of the invention are within the scope of the following claims. For example, the cross sectional shape of surface 54 in the direction of flow (arrow F) of the orifice inlet section 46 could be in the form of a curvilinear arc which simply approximates the circular and elliptical arcs described herein.

Also, the contoured surface of the inlet section 46 connecting through the body 22 the fluid supply source could be machined directly in the frame 12.

In addition, the diffuser slots 62 oriented along a long axis, X, disposed essentially transverse to a radial line, R, drawn from the center axis, A, of the diffuser 42, could have a kidney or other generally elongated shape that permits providing the desired minimum area for the slot 62, as a percentage of the total area of the diffuser 42, but adjusts the spread of the web-like spray component generated by the arrangement of slots, as described above. The diffuser 42 may have a shape other than round, and the transverse slots 62 may be joined by a radially outwardly extending channel 63 extending to the outside edge 64 of the diffuser. The position of an axis, Y, of the channel may be varied as desired to obtain different predetermined spray patterns, e.g. the axis, Y, may be disposed coaxially along radial line, R, and substantially transverse to slot long axis, X, as shown in FIG. 3; or the axis Y may be re-positioned to assume a different relationship relative to radial line, R, and/or to slot long axis, X.

These alterations among others would be obvious to those skilled in the art.

What is claimed is:

1. In a fire protection nozzle of the type comprising a base, an orifice, defined by said base and having a predetermined diameter, through which fire-retardant fluid can flow, an inlet section having an upstream end and defining a conduit for flow of the fire-retardant fluid along a conduit axis and leading to an upstream end of said orifice, a diffuser element positioned downstream of said orifice, and one or more arms extending from said base and supporting said diffuser element in a position, where, when flow of the fire-retardant fluid from said inlet section through said orifice is established, the fire-retardant fluid emerges from said orifice in a stream which impinges on said diffuser element to be deflected in a spray pattern, the improvement wherein said inlet section, in the direction of the fire-retardant fluid flow, has a conduit surface defining a cross-sectional shape of an inwardly convex curvilinear arc, said inlet section has a length equal to or greater than the diameter of said orifice, and said conduit surface, at said upstream end of said inlet section, lies substantially tangent to a plane perpendicular to said conduit axis.

2. The fire protection nozzle of claim 1, wherein the inwardly convex curvilinear arc of the cross-sectional shape of said inlet section has the form of a circular arc, with the center of said circular arc located proximate to a plane of said upstream end of said orifice.

3. The fire protection nozzle of claim 2, wherein the radius of said circular arc is between one and three times the diameter of said orifice.

4. The fire protection nozzle of claim 3, wherein the radius of said circular arc is approximately 1.5 times the diameter of said orifice.

5. The fire protection nozzle of claim 1, wherein the inwardly convex curvilinear arc of the cross-sectional shape of said inlet section has the form of an ellipse and the center of the ellipse is located proximate to a plane of said upstream end of said orifice.

6. The fire protection nozzle of claim 5, wherein said ellipse has a major axis with a length between 1.5 and 4.0 times the diameter of said orifice, and said ellipse has a minor axis with a length between 1.0 and 3.0 times the diameter of said orifice.

7. The fire protection nozzle claim 6, wherein the length of the major axis of said ellipse is nominally 2.0 times the diameter of said orifice and the length of the minor axis of the ellipse is nominally 1.3 times the diameter of said orifice.

8. The fire protection nozzle of claim 1, wherein the inwardly convex curvilinear arc of the cross-sectional shape of said inlet section has the form of a smooth blend of two or more circular arcs of different radii, the two or more circular arcs in combination approximating the form of an ellipse.

9. The fire protection nozzle of claim 1, wherein the cross-sectional area of said conduit, measured in a first plane at an upstream end of said inlet section and transverse to the direction of the fire-retardant fluid flow, is at least five times the cross-sectional area of said orifice measured in a second plant transverse to the direction of the fire-retardant fluid flow.

10. The fire protection nozzle of claim 1, wherein the diameter of said orifice is between about 0.08 inch and 0.20 inch.

11. The fire protection nozzle of claim 10, wherein the diameter of said orifice is nominally 0.11 inch.

12. The fire protection nozzle of claim 1, wherein said orifice has an exit end with a corner having a cross-sectional contour essentially in the form of a square corner.

13. In a fire protection nozzle of the type comprising a base, an orifice defined by said base through which fire-retardant fluid can flow, an inlet section defining a conduit for flow of the fire-retardant fluid leading to said orifice, a diffuser element positioned downstream from said orifice, and one or more arms extending from said base for supporting said diffuser element, in a position where, when flow of the fire-retardant fluid through said orifice is established, the fire-retardant fluid emerges from said orifice and impinges on said diffuser element to be deflected in a spray pattern, the improvement wherein said diffuser element defines two or more slots positioned for through-flow of a portion of the fire retardant fluid emerging from said orifice, said diffuser element having a total cross-sectional area measured in a plane transverse to the direction of the fire-retardant fluid flow from said orifice, and each said slot having a cross-sectional open area, measured in said plane, equal to at least eight percent of the total cross-sectional area of said diffuser element.

14. The fire protection nozzle of claim 13, wherein said diffuser element and said orifice are coaxially arranged, and each said slot has a long axis disposed substantially transverse to a radial line drawn from the axis of the diffuser element.

15. The fire protection nozzle of claim 13, wherein said diffuser element and said orifice are coaxially arranged, and said diffuser element defines four slots, each said slot having a cross-sectional open area measured in said plane approximately equal to ten percent of the total area of the diffuser element in said plane, and each said slot has a long axis disposed substantially transverse to a radial line drawn from the axis of said diffuser element.

16. The fire protection nozzle of claim 13, wherein said diffuser element and said orifice are coaxially arranged, each said slot has a long axis disposed substantially transverse to a radial line drawn from the axis of the diffuser element, and an open channel is defined between an associated said slot and an outer edge of said diffuser element, said channel being narrower than the associated said slot.

17. The fire protection nozzle of claim 16, wherein said channel has an axis generally aligned with a radial line drawn from the axis of the diffuser element and substantially transverse to the long axis of the associated said slot.

18. The fire protection nozzle of claim 16, wherein said channel has an axis generally aligned with a radial line drawn from the axis of the diffuser element.

19. The fire protection nozzle of claim 16, wherein said channel has an axis substantially transverse to the long axis of the associated said slot.

* * * * *

UNITED STATES PATENT AND TRADEMARK OFFICE

CERTIFICATE OF CORRECTION

PATENT NO. : 5,392,993

DATED : February 28, 1995

INVENTOR(S) : Michael Fischer

It is certified that error appears in the above-identified patent and that said Letters Patent is hereby corrected as shown below:

Col. 10, Claim 9, line 40, "plant" should be --plane--.

Signed and Sealed this

Fifth Day of March, 1996

*Attest:*

*Attesting Officer*

BRUCE LEHMAN

*Commissioner of Patents and Trademarks*